US012025341B2

(12) United States Patent
Zavodny et al.

(10) Patent No.: US 12,025,341 B2
(45) Date of Patent: Jul. 2, 2024

(54) INDIVIDUAL DRIVING OF NEBULIZERS BASED ON HVAC CONDITIONS

(71) Applicant: Ademco Inc., Golden Valley, MN (US)

(72) Inventors: Ludek Zavodny, Kozlovice (CZ); Milan Krkoska, Brno (CZ); Martin Tatak, Brno (CZ); Samuel Raymakers, Plymouth, MN (US)

(73) Assignee: Ademco Inc., Golden Valley, MN (US)

( * ) Notice: Subject to any disclaimer, the term of this patent is extended or adjusted under 35 U.S.C. 154(b) by 410 days.

(21) Appl. No.: 16/869,448

(22) Filed: May 7, 2020

(65) Prior Publication Data

US 2021/0348777 A1 Nov. 11, 2021

(51) Int. Cl.

| | |
|---|---|
| ***F24F 6/12*** | (2006.01) |
| ***F24F 6/00*** | (2006.01) |
| *F24F 110/10* | (2018.01) |
| *F24F 110/20* | (2018.01) |
| *F24F 110/30* | (2018.01) |
| *F24F 110/40* | (2018.01) |
| *F24F 120/20* | (2018.01) |

(52) U.S. Cl.

CPC ..... *F24F 6/12* (2013.01); *F24F 2006/008* (2013.01); *F24F 2110/10* (2018.01); *F24F 2110/20* (2018.01); *F24F 2110/30* (2018.01); *F24F 2110/40* (2018.01); *F24F 2120/20* (2018.01)

(58) Field of Classification Search

CPC .... F24F 6/12; F24F 2006/008; F24F 2110/10; F24F 2110/20; F24F 11/0008

See application file for complete search history.

(56) References Cited

U.S. PATENT DOCUMENTS

| | | | | |
|---|---|---|---|---|
| 3,880,124 | A * | 4/1975 | Stratton | F02M 25/0225 123/25 J |
| 6,027,030 | A * | 2/2000 | Buijsse | B05B 7/2489 236/44 C |
| 7,320,459 | B2 | 1/2008 | Johns | |
| 9,352,063 | B2 | 5/2016 | Ooten | |
| 9,743,559 | B2 * | 8/2017 | Ryu | H05K 7/20745 |
| 9,976,765 | B2 | 5/2018 | Benosman et al. | |
| 10,215,430 | B2 | 2/2019 | Blackley | |

(Continued)

FOREIGN PATENT DOCUMENTS

JP H05296535 A 11/1993

OTHER PUBLICATIONS

2005 ASHRAE Handbook—Fundamentals (SI Edition), American Society of Heating, Refrigerating and Air-Conditioning Engineers, Inc., Chapter 6, pp. 6.1-6.17, (2005).

*Primary Examiner* — Lionel Nouketcha

(74) *Attorney, Agent, or Firm* — Greenberg Traurig, LLP; Ryan D. Sharp; David J. Dykeman

(57) ABSTRACT

A humidifier device includes one or more sensors configured to sense one or more air properties of air within a duct operably coupled to the humidifier device. The humidifier also includes control circuitry configured to receive an indication of the one or more air properties of the air, determine a water absorption capability of the air based at least in part on the one or more air properties of the air, and determine an amount of moisture to be outputted by the humidifier device to the duct based at least in part on the water absorption capability of the air. The humidifier also includes an atomizer configured to output the determined amount of moisture to the duct.

13 Claims, 4 Drawing Sheets

(56) References Cited

U.S. PATENT DOCUMENTS

| | | | | |
|---|---|---|---|---|
| 2009/0169420 | A1 | 7/2009 | Pollizi et al. | |
| 2013/0139996 | A1* | 6/2013 | Hashimoto | F24F 3/167 165/11.1 |
| 2018/0066862 | A1* | 3/2018 | Peczalski | F24F 6/00 |
| 2018/0093291 | A1* | 4/2018 | Benjamin | F24F 6/12 |

* cited by examiner

INDIVIDUAL DRIVING OF NEBULIZERS BASED ON HVAC CONDITIONS

TECHNICAL FIELD

The disclosure relates to heating, ventilation, and air conditioning (HVAC) humidifier systems.

BACKGROUND

Some forced air heating ventilation and air conditioning systems (HVAC) may include a humidifier appliance to add moisture to the air. In some examples, an HVAC system may air into an air duct and a humidifier can be mounted to the air duct to emit a fine water mist into the air within the air duct, thereby adding moisture to the air within the air duct.

SUMMARY

In general, aspects of the present the disclosure are directed to a humidifier device in which nebulizer elements may be individually driven based on the air conditions of the air within an air duct that is supplied by a heating, ventilation, and air conditioning (HVAC) system. The humidifier device may be able to measure one or more air properties of the air in a duct supplied by an HVAC device and may determine, based on the one or more air properties, the water absorption capability of the air in the duct. The humidifier device may drive individual nebulizer elements to output an amount of moisture that corresponds to the water absorption capability of the air in the duct. The humidifier device may continuously measure the one or more air properties of the air in the duct and may adjust the amount of moisture it outputs based on changes in the one or more air properties in the air, such as by driving additional nebulizer elements to increase the amount of moisture it outputs, or by ceasing to drive one or more nebulizer elements to decrease the amount of moisture it outputs.

In one example, the disclosure is directed to a method. The method includes receiving, by control circuitry of a humidifier device from one or more sensors, an indication of one or more air properties of air within a duct. The method further includes determining, by the control circuitry, a water absorption capability of the air based at least in part on the one or more air properties of the air within the duct. The method further includes determining, by the control circuitry, an amount of moisture to be output by the humidifier device to the duct based at least in part on the water absorption capability of the air. The method further includes outputting, by an atomizer of the humidifier device, the determined amount of moisture to the duct.

In one example, the disclosure is directed to a humidifier device. The humidifier device includes one or more sensors configured to sense one or more air properties of air within a duct operably coupled to the humidifier device. The humidifier device further includes control circuitry configured to: receive, from the one or more sensors, an indication of the one or more air properties of the air within the duct; determine a water absorption capability of the air based at least in part on the one or more air properties of the air within the duct; and determine an amount of moisture to be outputted by the humidifier device to the duct based at least in part on the water absorption capability of the air. The humidifier device further includes an atomizer configured to output the determined amount of moisture to the duct.

The details of one or more examples are set forth in the accompanying drawings and the description below. Other features, objects, and advantages will be apparent from the description, drawings, and claims.

BRIEF DESCRIPTION OF DRAWINGS

FIG. 3 illustrates an example technique for compensating for inaccurate measurements produced by an example sensor, in accordance with aspects of the present disclosure.

DETAILED DESCRIPTION

Figure 1:
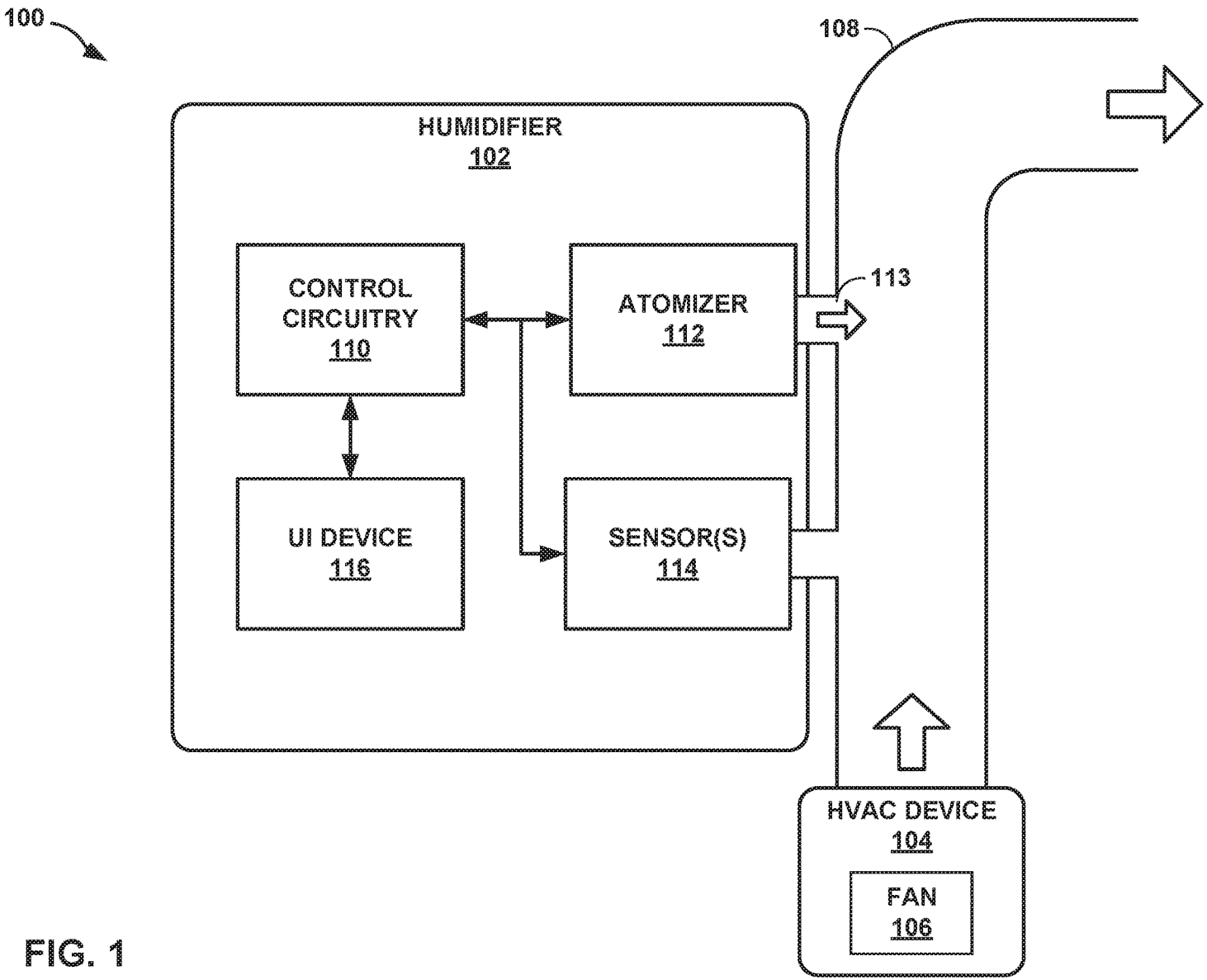
FIG. 1 illustrates an example humidifier device installed in a heating, ventilation, and air conditioning (HVAC) system according to one or more techniques of this disclosure.

FIG. 1 illustrates an example humidifier device installed in a heating, ventilation, and air conditioning (HVAC) system according to one or more techniques of this disclosure. The example of system 100 is one possible arrangement for a forced air HVAC system. In other examples, system 100 may include more or fewer components and a different arrangement of components.

As shown in FIG. 1, example system 100 includes humidifier device 102, HVAC device 104, and duct 108. System 100 may, for example, be installed in a residential or commercial building to heat, cool, filter, remove humidity, or circulate air within the building. HVAC device 104 may be operably coupled to duct 108 and may be configured to output air into duct 108. Humidifier device 102 may be operably coupled to duct 108 and may be configured to output moisture into duct 108, thereby humidifying the air flowing through duct 108.

Duct 108 in the example of system 100 may be an HVAC duct configured to convey air outputted by HVAC device 104 to, for instance, an inside space of a building or structure. Duct 108 may have a cross section of any suitable shape, such as a circular-shaped cross section, a rectangular-shaped cross section, and the like.

HVAC device 104 may be a heat exchanger, a heater, an air conditioner, or any other device that directs streams of air to duct 108. In some examples, HVAC device 104 includes heating and/or cooling elements that heats and/or cools the air that it directs to duct 108. In some examples, HVAC device 104 includes fan 106. Fan 106 may operate at any suitable speed in order to control the speed at which HVAC device 104 outputs air into duct 108.

Humidifier device 102 may be any suitable device configured to provide moisture into duct 108 to humidify the air being conveyed by duct 108, such as the air being output by HVAC device 104 into duct 108. Humidifier device 102 may include control circuitry 110, atomizer 112, one or more sensors 114, and user interface device 116. Although not explicitly shown in FIG. 1, humidifier 102 may also include a water source such as a water tank or water inlet.

Atomizer 112 of humidifier device 102 may be any suitable device that is capable to produce moisture such as water flow, water mist, and the like, so that humidifier device 102 may use atomizer 112 to output moisture into duct 108. Humidifier device 102 may be coupled to duct 108 such that atomizer 112 of humidifier device 102 is positioned to provide moisture to the air being conveyed within duct 108.

For example, duct 108 may include an opening 113 through which atomizer 112 of humidifier device 102 is able to provide the moisture to the air within duct 108.

One or more sensors 114 of humidifier device 102 are positioned with respect to duct 108 so that they are able to sense one or more properties of the air within duct 108. One or more sensors 114 may include any combination of humidity sensors, temperature sensors, air velocity sensors, air pressure sensors, air flow sensors, and similar sensors that determine the properties and conditions of the air within duct 108 and provide information to control circuitry 110 to configure and control the operation of humidifier device 102. In some examples one or more sensors 114 may be operatively coupled to control circuitry 110 and send signals to control circuitry 110 with raw information such as the temperature or the air pressure of the air within duct 108.

User interface device 116 of humidifier device 102 may include an input device and an output device for humidifier device 102. For instance, user interface device 116 may include a touchscreen, a keyboard, a touchpad, or any other suitable input device for receiving user input, such as from a user of humidifier device 102. Further, user interface device 116 may include a display device, loudspeakers, or any other device capable of outputting visible and/or audible information, such as to a user of humidifier device 102.

Control circuitry 110 of humidifier device 102 may be operably coupled to atomizer 112, one or more sensors 114, and user interface device 116, and may be configured to control the operations of humidifier device 102. In particular, control circuitry 110 may be configured to control the amount of moisture that atomizer 112 outputs into duct 108 based at least in part on air properties of the air within duct 108 measured by one or more sensors 114.

Examples of control circuitry 110 of humidifier may include any one or more of a microcontroller (MCU), e.g. a computer on a single integrated circuit containing a processor core, memory, and programmable input/output peripherals, a microprocessor (μP), e.g. a central processing unit (CPU) on a single integrated circuit (IC), a controller, a digital signal processor (DSP), an application specific integrated circuit (ASIC), a field-programmable gate array (FPGA), a system on chip (SoC) or equivalent discrete or integrated logic circuitry. A processor in control circuitry 110 may be integrated circuitry, i.e., integrated processing circuitry, and that the integrated processing circuitry may be realized as fixed hardware processing circuitry, programmable processing circuitry and/or a combination of both fixed and programmable processing circuitry.

Control circuitry 110 may be configured to receive signals from one or more sensors 114 indicative of one or more air properties of the air in duct 108 sensed by one or more sensors 114 and may accordingly adjust the amount of moisture that atomizer 112 outputs into the air within duct 108 based on the one or more air properties sensed by one or more sensors 114. One or more sensors 114 may continuously sense the air properties of the air flowing through duct 108 and may send indications of such sensed air properties to control circuitry 110. For example, control circuitry 110 may receive from one or more sensors indications of one or more of: a relative humidity of the air, a temperature of the air, an air pressure of the air, an air velocity of the air, and the like.

Control circuitry 110 may be configured to determine, based at least in part on the indications of the one or more air properties received from one or more sensors 114, an amount of moisture that atomizer 112 outputs to duct 108 to humidify the air in duct 108. To that end, control circuitry 110 may determine the water absorption capability of the air based at least in part on the one or more air properties of the air within duct 108.

Control circuitry 110 may be configured to determine an amount of moisture to be outputted by atomizer 112 to duct 108 based at least in part on the water absorption capability of the air, and atomizer 112 may be configured to output, to duct 108, the determined amount of moisture. By determining the water absorption capability of the air, control circuitry 110 may be able to determine the appropriate amount of moisture that atomizer 112 outputs into that air.

For example, by determining the water absorption capability of the air, control circuitry 110 may prevent atomizer 112 from outputting more moisture than can be absorbed by the air, thereby potentially preventing condensation in duct 108 due to unevaporated moisture. Similarly, by determining the water absorption capability of the air, control circuitry 110 may also prevent atomizer 112 from outputting an insufficient amount of moisture into the air, thereby potentially preventing the air from being overly dry.

In addition, control circuitry 110 may be able to adjust the amount of moisture that atomizer 112 outputs into that air as the water absorption capability of the air changes, thereby ensuring that the air is sufficiently humidified as the condition of the air in duct 108 changes. One or more sensors 114 may be configured to continuously sense the air properties of the air in duct 108 and may send indications of such air properties to control circuitry 110. Control circuitry 110 may be configured receive the indications of such air properties and may, in response, update its determination of the water absorption capability of the air based at least in part on the air properties. Control circuitry 110 may be configured, in response to updating its determination of the water absorption capability of the air, to redetermine the amount of moisture to be outputted by atomizer 112 based at least in part on the updated water absorption capability of the air, and atomizer 112 may output the redetermined amount of moisture to duct 108. In this way, humidifier device 102 is able to continuously adjust to ever changing conditions of the air in duct 108 by adjusting the amount of moisture it outputs in duct 108 based on such changing conditions.

Figure 2:
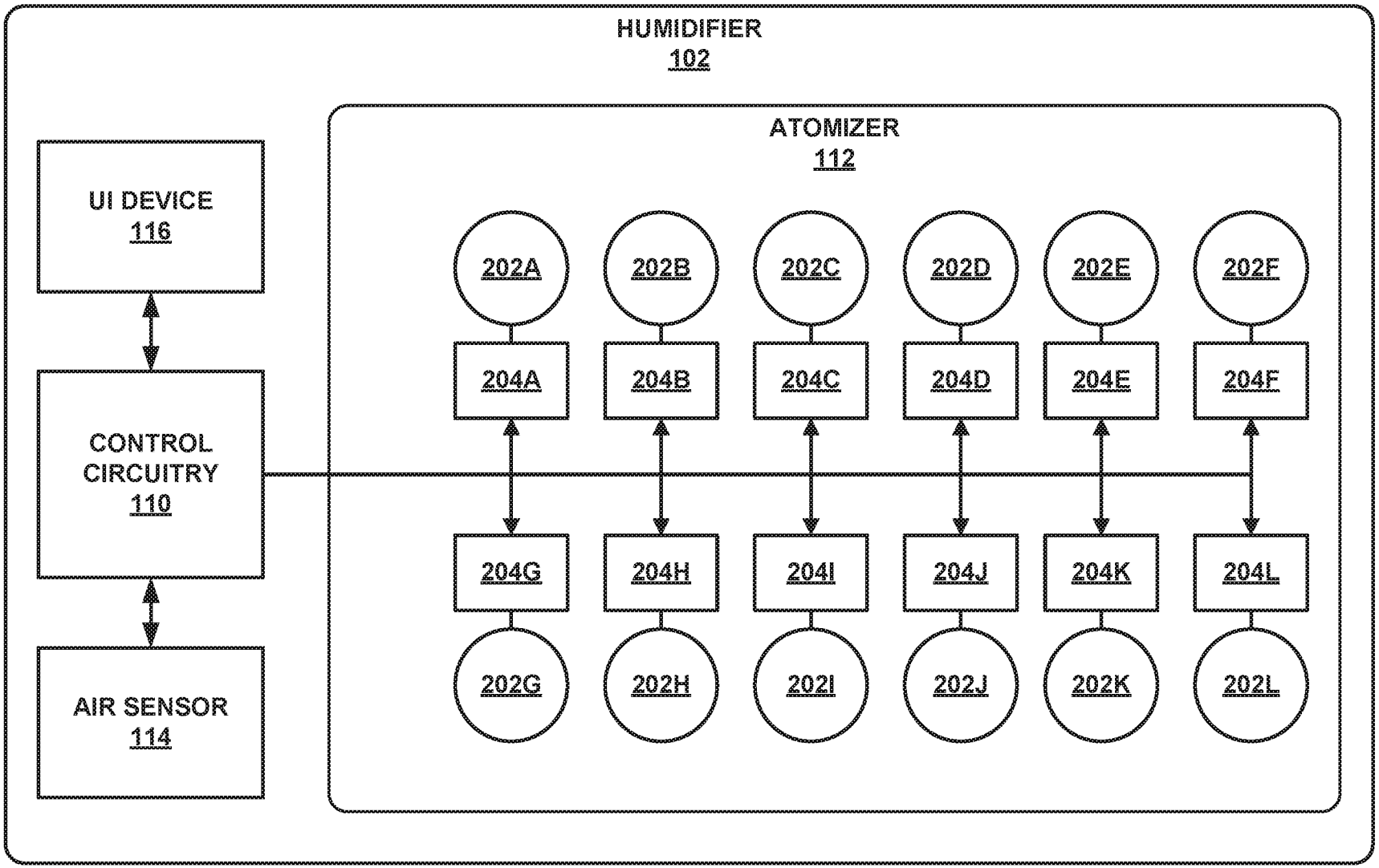
FIG. 2 illustrates the example humidifier device of FIG. 1 in further detail.

FIG. 2 illustrates the example humidifier device 102 of FIG. 1 in further detail. As shown in FIG. 2, atomizer 112 of humidifier device 102 includes nebulizer elements 202A-202L (hereafter "nebulizer elements 202") driven by power driving circuitry 204A-204L (hereafter "power driving circuitry 204") operably coupled to nebulizer elements 202 to generate and output moisture such as in the form of mist or other forms of water flow.

Driving circuitry 204 may be driver circuits that control corresponding nebulizer elements 202. Control circuitry 110 is operably coupled to driving circuitry 204A-204L to drive individual nebulizer elements of nebulizer elements 202. By driving a nebulizer element, control circuitry 110 causes the driven nebulizer element to produce water flow. For example, if control circuitry 110 drives nebulizer element 202C via driving circuitry 204C, control circuitry 110 may cause nebulizer element 202C, when driven by control circuitry 110, to produce water flow. If control circuitry 110 stops driving nebulizer element 202C, then control circuitry 110 may cause nebulizer element 202C to stop producing water flow.

To drive an individual nebulizer element of nebulizer elements 202, control circuitry 110 may send a signal, such as power to drive the nebulizer element or any other signal to activate the nebulizer element and to cause the nebulizer element to output moisture, to the driving circuitry of driving circuitry 204 that corresponds to the nebulizer element to cause the nebulizer element to output moisture. In one example, when control circuitry 110 drives nebulizer element 202H via driving circuitry 204H, control circuitry sends power to driving circuitry 204H to turn on nebulizer element 202H and to cause nebulizer element 202H to produce water flow. To stop driving nebulizer element 202H to stop nebulizer element 202H from producing water flow, control circuitry 110 may stop sending power to driving circuitry 204H, thereby turning off the water flow produced by nebulizer element 202H, In another example, to drive nebulizer element 202D via driving circuitry 204D, control circuitry 110 may send a drive signal to driving circuitry 204D, and driving circuitry 204D may, upon receiving the drive signal, send power to nebulizer element 202D to cause nebulizer element 202D to produce water flow. Similarly, to cease driving nebulizer element 202D, control circuitry 110 may send a stop signal to driving circuitry 204D, and driving circuitry 204D may, upon receiving the stop signal, cease sending power to nebulizer element 202D, thereby causing nebulizer element 202D to stop producing water flow.

As can be seen, control circuitry 110 can control individual nebulizer elements of nebulizer elements 202 to cause or to stop individual nebulizer elements of nebulizer elements 202 from producing water flow. In this way, by being able to control whether each individual nebulizer is active and producing water flow or is inactive and not producing water flow, control circuitry 110 has fine grained control of the amount of water flow that atomizer 112 outputs by controlling the exact number of individual nebulizer elements of nebulizer elements 202 that are actively producing water flow at any one time.

Because control circuitry 110 is able to drive individual nebulizer elements of nebulizer elements 202, control circuitry 110 is able to control the amount of moisture that atomizer 112 outputs by controlling the exact number of individual nebulizer elements within atomizer 112 that are actively outputting a flow of water mist into duct 108. For example, control circuitry 110 may increase the number of individual nebulizer elements that it drives in atomizer 112 to increase the amount of moisture being output by atomizer 112, such as by driving one or more additional nebulizer elements that were previously not being driven by control circuitry 110, and may decrease the number of individual nebulizer elements that it drives in atomizer 112 to decrease the amount of moisture being output by atomizer 112, such as ceasing to drive one or more nebulizer elements that were being driven by control circuitry 110 to produce water flow.

Because each individual nebulizer element of nebulizer elements 202 produces a certain amount of water flow that is the same for each individual nebulizer element of nebulizer elements 202, control circuitry 110 may control the moisture that atomizer 112 outputs by determining the number of individual nebulizer elements of nebulizer elements 22 that together, would produce a certain amount of moisture by dividing the amount of moisture to be produced by the moisture produced by a single nebulizer element of nebulizer elements 202. In this way, control circuitry 110 may control the amount of moisture produced by atomizer 112.

As discussed above, control circuitry 110 may determine the amount of moisture that atomizer 112 outputs to duct 108 based at least in part on the water absorption capability of the air in duct 108. The ability of the air in duct 108 to absorb water may depend on properties of the air in duct 108, the properties of duct 108, and the like. Thus, when properties of the air in duct 108 change, the ability of the air to absorb water may also change. However, if the amount of moisture that is outputted by humidifier device 102 does not change when the air's ability to absorb water outputted by humidifier device 102 changes, the amount of moisture outputted by humidifier device 102 may introduce too much moisture or too little moisture into the air in duct 108. For example, if humidifier device 102 introduces too little moisture, the air may therefore not be sufficiently humidified. On the other hand, if humidifier device 102 introduces too much moisture, the air may become saturated with the moisture such that a portion of the moisture introduced by humidifier device 102 may end up not being evaporated, thereby potentially causing mold growth or damage to duct 108.

In accordance with aspects of the present disclosure, humidifier device 102 may adjust the amount of moisture it outputs based at least in part on the properties of the air flowing within duct 108, so that the amount of moisture outputted by humidifier device 102 changes along with changes in conditions of the air within duct 108. In particular, humidifier device 102 may control individual nebulizer elements of nebulizer elements 202 to change the amount of moisture outputted by humidifier device 102 based at least in part on changes in conditions of the air within duct 108

For example, to determine the amount of moisture to be output by humidifier device 102 into duct 108, control circuitry 110 may be configured to determine the amount of water flow that can be absorbed by the air flowing within duct 108, and to thereby determine the amount of moisture outputted by humidifier device 102 to correspond to the amount of water flow that can be absorbed by the air flowing within duct 108. Control circuitry 110 may be configured to determine the amount of water flow that can be absorbed by the air flowing within duct 108 based at least in part on determining a theoretical water absorption capability of the air within duct 108. The water absorption capabilities of the air in duct 108 may be expressed as the amount of water that can be absorbed for a particular unit of air, such as the number of kilograms of water that can be absorbed per one kilogram of air, the amount of water that can be absorbed for a particular unit of air over a specified time period (e.g., per second, per minute, etc.), and the like.

Control circuitry 110 may be configured to determine the theoretical water absorption capability of the air in duct 108 based on one or more properties of the air flowing within duct 108, such as one or more of: the air temperature, the relative humidity, and/or the air pressure. For example, control circuitry 110 may determine the theoretical water absorption capacity of the air as a regression function based on the one or more properties of the air flowing within duct 108. In this way, control circuitry 110 may determine the water absorption capabilities of the air within duct 108 based at least in part on the one or more properties of the air flowing within duct 108.

One or more sensors 114 may sense one or more properties of air within duct 108 and may send an indication of such one or more properties of the air to control circuitry 110. For example, one or more sensors 114 may include one or more of: an air temperature sensor, an air humidity sensor, and/or an air pressure sensor that sense one or more of: the air temperature, the relative humidity, and/or the air pressure of air within duct 108, and one more sensors 114 may send an indication of such air properties to control circuitry 110. One or more sensors 114 may periodically sense, measure, or otherwise gather such properties of the air within duct 108, such as every second, every five seconds, every thirty seconds, every minute, and the like, in order to provide such up-to-date information regarding the properties of the air within duct 108 to control circuitry 110.

Because air moves within duct 108 and because the dimensions of duct 108 may also affect the amount of water flow that can be absorbed by the air flowing within duct 108, the amount of water flow that can be absorbed by the air flowing within duct 108 may be based on not just the theoretical water absorption capability of the air within duct 108. Instead, the amount of water flow that can be absorbed by the air flowing within duct 108 may further be based on at least one or more of: the air velocity of the air moving within duct 108 and/or the area of a cross-section of duct 108. For example, if duct 108 has a circular cross-sectional area, the area of the cross-section of duct 108 may be $\pi r^2$, where r is the radius of the cross-sectional area of duct 108.

An example equation for determining the amount of water that can be absorbed by the air flowing within duct 108 based at least in part on the properties of the air flowing within duct 108 is as follows:

$$\text{WaterFlow}=\text{SafetyMargin}*\text{Area}*\text{velocity}*\text{TheoreticalWaterAbsoptionCapacity}(T,RH,p) \quad (1)$$

In equation (1), TheoreticalWaterAbsorptionCapacity is the theoretical water absorption capability of the air in duct 108. TheoreticalWaterAbsorptionCapacity in equation (1) is determined based on parameters T, RH, and p, where T is the air temperature, RH is the relative humidity of the air, and p is the air pressure, all of which may be measure by one or more sensors 114. As discussed above, in some examples, TheoreticalWaterAbsorptionCapacity may be a regression function based on the air temperature, relative humidity of the air, and the air pressure. Further, in equation (1), the TheoreticalWaterAbsorptionCapacity is multiplied by the parameters Velocity and Area, where Velocity is the air velocity at which the air moves through duct 108 and Area is the cross sectional area of duct 108.

Note that equation (1) the TheoreticalWaterAbsorption-Capacity is also based on a SafetyMargin parameter. The SafetyMargin parameter is a value that introduces a margin of safety in equation (1) to help ensure that the water flow introduced by humidifier device 102 to the air flowing through duct 108 is less than the maximum amount of water flow that can be carried by air flowing through duct 108. As such, for example, SafetyMargin may have a value of less than 1.0. Thus, if SafetyMargin has, for example, a value of 0.95, the SafetyMargin may enable humidifier device 102 to provide 95% of the maximum amount of water flow that can be carried by air flowing through duct 108. In this way, control circuitry 110 is able to use equation (1) to determine a value for WaterFlow, which is the amount of water flow that can be absorbed by the air flowing within duct 108

By determining the amount of water flow that can be absorbed by the air flowing within duct 108, such as according to equation (1), control circuitry 110 may be able to determine the number of active nebulizer elements in atomizer 112 that would be able to provide a corresponding amount of water flow that may be equal to the determined amount of water flow that can be absorbed by the air within duct 108. In this way, control circuitry 110 may be determine the amount of moisture to be supplied by atomizer 112 and to control atomizer 112 to supply the determined amount of moisture.

As described above, atomizer 112 may include nebulizer elements 202 that may be individually driven by control circuitry 110. Individually driving nebulizer elements 202 includes control circuitry 110 being able to control each individual nebulizer element (e.g., each one of nebulizer elements 202A-202L) independently from the other nebulizer elements in nebulizer elements 202. As such, control circuitry 110 may turn on and turn off individual nebulizer elements independently from other nebulizer elements in nebulizer elements 202. In this way, control circuitry 110 may control the amount of moisture supplied by atomizer 112 by controlling individual nebulizer elements of nebulizer elements 202.

To that end, control circuitry 110 may be configured to determine an amount of moisture to be outputted atomizer 112 that corresponds to the water flow that may be carried by air flowing through duct 108 as determine using equation (1). In particular, control circuitry 110 may determine the number of nebulizer elements of nebulizer elements 202 that in total outputs the determined amount of moisture, as follows:

$$\text{WaterFlow}=\text{WaterFlowOfOneNebulizer}*\text{NumberOfNebulizersRunning} \quad (2)$$

WaterFlowOfOneNebulizer is a parameter that represents amount of water flow produced by a single nebulizer element of nebulizer elements 202. Control circuitry 110 may be configured to determine an amount of waterflow produced by a single nebulizer element by continually measuring the amount of water flow produced by an individual nebulizer element of nebulizer elements 202. Thus, control circuitry 110 may determine the total amount of water flow, represented by the parameter WaterFlow, for a given number of individual nebulizer elements that are producing water flow, represented by the parameter NumberOfNebulizers-Running, by multiplying the water flow of an individual nebulizer element with the given number of individual nebulizer elements that are producing water flow.

Control circuitry 110 may combine equations (1) and (2) to determine the number of nebulizer elements that together produces an amount of water flow that corresponds to the amount of water flow that may be carried by air flowing through duct 108. Because the right side of both equations (1) and (2) are equal to the parameter WaterFlow, control circuitry 110 may equate the right side of equation (1) with the right side of equation (2) as follows:

$$\text{NumberOfNebulizersRunning}*\text{WaterFlowOfOne Nebulizer}=\text{SafetyMargin}*\text{Area}*\text{velocity}*\text{TheoreticalWaterAbsoptionCapacity}(T,RH,p)/\text{WaterFlowOfOneNebulizer} \quad (3)$$

Thus, to determine the number of nebulizer elements that together produces an amount of water flow that corresponds to the amount of water flow that may be carried by air flowing through duct 108, control circuitry 110 may divide both sides of equation (3) with the parameter WaterFlowO-fOneNebulizer as follows:

$$\text{NumberOfNebulizersRunning}=\text{SafetyMargin}*\text{Area}*\text{velocity}*\text{TheoreticalWaterAbsoptionCapacity}(T,RH,p)/\text{WaterFlowOfOncNebulizer} \quad (4)$$

Thus, the number of individual nebulizer elements of nebulizer elements 202 that are to be driven may be a function of the water flow of an individual nebulizer element, the safety margin, the area of the cross section of duct 108, and the theoretical water absorption capacity of the air in duct 108. In this way, control circuitry 110 may determine, based at least in part on the water absorption capabilities of the air, an amount of moisture supplied by atomizer 112 of the humidifier device 102 by individually driving one or more nebulizer elements of a plurality of nebulizer elements 202 in the atomizer 112 to supply the amount of moisture.

Control circuitry 110 may be configured to determine, such as via the techniques described above, the number of individual nebulizer elements of nebulizer elements 202 that are to be driven to output a certain amount of water flow, and may accordingly control atomizer 112 to drive the determined number of individual nebulizer elements of nebulizer elements 202. To drive a nebulizer element of nebulizer elements 202, control circuitry 110 may send a signal, such as power to drive the nebulizer element or any other signal to activate the nebulizer element and to cause the nebulizer element to output moisture, to the driving circuitry of driving circuitry 204 that corresponds to the nebulizer element to cause the nebulizer element to output moisture.

Similarly, control circuitry 110 may control atomizer 112 to prevent individual nebulizer elements of nebulizer elements 202 from outputting moisture. For example, control circuitry 110 may refrain from driving individual nebulizer elements, such as refraining from providing power, via driving circuitry 204, to individual nebulizer elements to prevent those individual nebulizer elements from outputting moisture. In another example, control circuitry may refrain from driving individual nebulizer elements by sending a signal to the driving circuitry of the individual nebulizer elements indicating that those individual nebulizer elements are to refrain from outputting moisture.

When at least one or more of nebulizer elements 202 are already being driven by control circuitry 110 to output moisture to duct 108, control circuitry 110 may be configured to cease driving one or more of nebulizer elements 202 or to drive an additional one or more nebulizer elements 202 in order to drive a determined number of individual nebulizer elements of nebulizer elements 202. For example, if control circuitry 110 determines that seven individual nebulizer elements of nebulizer elements 202 would provide a desired amount of moisture, but only five individual nebulizer elements 202 are currently being driven, control circuitry 110 may drive an additional two (2) individual nebulizer elements of nebulizer elements 202. Similarly, if control circuitry 110 determines that eight individual nebulizer elements 202 are currently being driven, control circuitry 110 may cease driving one of the eight individual nebulizer elements currently being driven to result in seven individual nebulizer elements that are outputting moisture to duct 108.

Humidifier device 102 may be configured to use one or more sensors 114 to periodically measure the air properties of the air in duct 108, determine the amount of moisture that atomizer 112 is to output based at least in part on the measured air properties, determine the number of individual nebulizer elements of nebulizer elements 202 to be driven based at least in part on the determined amount of moisture to output, and to start driving one or more additional individual nebulizer elements of nebulizer elements 202 and/or refrain from driving one or more individual nebulizer elements of nebulizer elements 202 to drive the determined number of individual nebulizer elements. For example, one or more sensors 114 may continuously measure the air properties of the air in duct 108 and may continuously provide such measurements to control circuitry 110, or may periodically provide such measurements, such as every second, every five seconds, every thirty seconds, every minute, and the like.

Each time control circuitry 110 receives such measurements of the air properties from one or more sensors 114, control circuitry 110 may re-determine the amount of moisture that atomizer 112 is to output based on the measured air properties, and may adjust the number of individual nebulizer elements of nebulizer elements 202 to be driven to output the redetermined amount of moisture, as described above. In this way, humidifier device 102 may be able to continuously and/or periodically adjust the amount of moisture it outputs into duct 108 based on changes in the conditions of the air flowing within duct 108.

As described above, the amount of water flow that may be carried by air flowing through duct 10 may depend at least in part on the area of the cross section of duct 108, such as illustrated in equation (1) and equation (4). In some examples, control circuitry 110 may be programmed or hardwired with the specific area of the cross section of duct 108 to which humidifier device 102 is operably coupled to provide moisture for the air flowing within duct 108. In some examples, user interface device 116 of humidifier device 102 may be configured to receive user input that indicates the value of the area of the cross section of duct 108 to which humidifier device 102 is operably coupled and may transmit an indication of the inputted area the cross section of duct 108 to control circuitry 110.

In the example where user interface device 116 receives user input that indicates a value for the area of the cross section of duct 108, the user that provides the user input may be able adjust the amount of moisture that is outputted by humidifier device 102 by changing the value of the area of the cross section of duct 108 that the user inputs via user interface device 116 to humidifier device 102. For example, the user may increase the amount of moisture that humidifier device 102 outputs by inputting a relatively larger value as the area of the cross section of duct 108. Similarly, the user may decrease the amount of moisture that humidifier device 102 outputs by inputting a relatively smaller value as the area of the cross section of duct 108. When user interface device 116 receives user input that indicates an updated value for the area of the cross section of duct 108 and sends an indication of the updated value to control circuitry 110, control circuitry 110 may, in response, re-determine the amount of moisture that atomizer 112 is to output based on the updated value for the area of the cross section of duct 108, and may adjust the number of individual nebulizer elements of nebulizer elements 202 to be driven, as described above, thereby changing the amount of moisture that humidifier device 102 outputs based on the updated value inputted by the user.

As air flows through duct 108, particulates such as dust or other particles may move through and collect within duct 108. Such particulates may accumulate on or near one or more sensors 114 and may affect the accuracy of such one or more sensors 114. Because the amount of moisture that humidifier device 102 outputs into duct 108 may depend at least in part on the air properties sensed by one or more sensors 114, inaccurate sensor readings caused by particulates may lead to humidifier device 102 outputting an amount of moisture that is not well suited for the properties of the air flowing through duct 108.

For example, if one or more sensors 114 inaccurately senses a higher than actual air velocity in duct 108, such inaccurate readings may cause humidifier device 102 to output more moisture than can be carried by the air in duct 108, thereby potentially leading to condensation in duct 108 due to unevaporated moisture. Conversely, if one or more sensors 114 inaccurately senses a lower than actual air velocity in duct 108, such inaccurate readings may cause humidifier device 102 to output less moisture than may be optimal. In some examples, humidifier device 102 may shut down if the errors of one or more sensors 114 exceed acceptable limits.

In accordance with aspects of the present disclosure, humidifier device 102 may be configured to detect that one or more sensors 114 are being affected by particulates within duct 108 that cause one or more sensors 114 produce inaccurate measurements of properties of air in duct 108. Humidifier device 102 may, in response, be able to compensate for such inaccurate measurements and may be able to determine when humidifier device 102 may require maintenance.

To detect that one or more sensors 114 are being affected by particulates within duct 108 that cause one or more sensors 114 produce inaccurate measurements of properties of air in duct 108 and to compensate for such inaccurate measurements, control circuitry 110 may analyze the instant values generated from one or more sensors 114 over time and may determine a trend line of peak values and a trend line of low values over time of the values generated from one or more sensors 114. Control circuitry 110 may compare the value of the trend lines with the initial instant values generated from one or more sensors 114 at a specified initial time to compensate for possible inaccurate measurements produced by one or more sensors 114 and/or to determine that humidifier device 102 may require maintenance, such as to clean one or more sensors 114 of any particulates.

Figure 3:
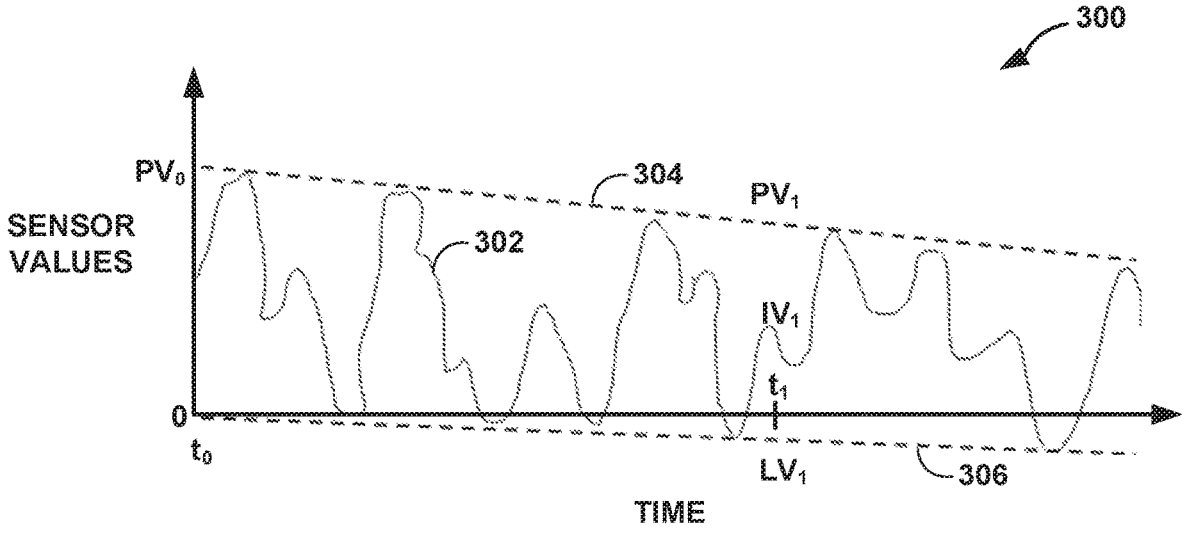
FIG. 3 is a conceptual diagram illustrating a detail view of an example evaporative humidifier according to one or more techniques of this disclosure.

FIG. 3 illustrates an example technique for compensating for inaccurate measurements produced by an example sensor, in accordance with aspects of the present disclosure. The example sensor may be any of one or more sensors 114, such as an air velocity sensor, an air pressure sensor, an air temperature sensor, and the like. As shown in FIG. 3, the example technique may be illustrated by way of example graph 300 that plots instant values 302 of generated from an example sensor of one or more sensors over time. Starting from an initial time to, control circuitry 110 may track the instant values 302 generated from the sensor over time. The initial time to may be any suitable initial time, such as the time when humidifier device 102 is turned on, the time after one or more sensors 114 of humidifier device 102 has been cleaned of particulates or other debris, a particular time of the day, and the like.

As control circuitry 110 tracks the instant values 302 generated from the sensor over time, control circuitry 110 may track peak values (e.g., maximum values, crest values, etc.) of instant values 302 and low values (e.g., negative peak values, troughs, etc.) of instant values 302, and may determine both a peak value trend line 304 from such tracked peak values of instant values 302 and a low value trend line 306 from such tracked low values of instant values 302. Control circuitry 110 may generate peak value trend line 304 and low value trend line 306 via any suitable technique for generating trend lines, such as techniques for generating a linear trend line, an exponential trendline, and the like.

Control circuitry 110 may be configured to compensate for inaccurate measurements produced by an example sensor based at least in part on instant values 302 and one or more of: peak value trend line 304 or low value trend line 306. For example, control circuitry 110 may, at a particular time after the initial time to, determine a difference between the instant value of the peak value trend line at the particular time and an initial value of the peak value trend line. Such a difference may be referred to herein as a peak value trend delta. Control circuitry 110 may then add or subtract the peak value trend delta to or from the instant value produced by the example sensor at the particular time to compensate for possible inaccurate instant values produced by the example sensor.

In the example of FIG. 3, control circuitry 110 may determine an initial peak value $PV_0$ at initial time to based at least in part on peak value trend line 304. To compensate for a possibly inaccurate instant value $IV_1$ at time $t_1$, circuitry 110 may determine peak value $PV_1$ at time $t_1$, which may be the value of peak value trend line 304 at time $t_1$. Control circuitry 110 may determine a difference between peak value $PV_1$ and initial peak value $PV_0$ and may add or subtract the resulting peak value trend delta to or from instant value $IV_1$ to produce a compensated instant value for the example sensor at time t1. In the example of an air flow sensor, because particulates may typically cause the air sensor to produce air flow measurements that are lower than actual air flow measurements, control circuitry 110 may add the peak value trend delta to the instant value produced by the air flow sensor at the particular time.

In another example, control circuitry 110 may, at a particular time after the initial time to, determine a difference between the instant value of the low value trend line at the particular time and zero, because the example sensor, when providing accurate measurements, may not produce a negative value. Such a difference may be referred to herein as a low value trend delta. Control circuitry 110 may then add or subtract the low value trend delta to or from the instant value produced by the example sensor at the particular time to compensate for possible inaccurate instant values produced by the example sensor.

In the example of FIG. 3, to compensate for a possibly inaccurate instant value $IV_1$ at time $t_1$, circuitry 110 may determine low value $LV_1$ at time $t_1$, which may be the value of low value trend line 306 at time $t_1$. Control circuitry 110 may determine a difference between low value $LV_1$ and zero and may add or subtract the resulting low value trend delta to or from instant value $IV_1$ to produce a compensated instant value for the example sensor at time t1. In the example of an air flow sensor, because particulates may typically cause the air sensor to produce air flow measurements that are lower than actual air flow measurements, control circuitry 110 may add the low value trend delta to the instant value produced by the air flow sensor at the particular time.

In some examples, peak value trend line 304 and low value trend line 306 may be combined to compensate for a possibly inaccurate instant value. For example, control circuitry 110 may determine an average value of the peak value trend delta and the low value trend delta and may add or subtract the determined average value to the instant value to produce a compensated instant value.

Further, control circuitry 110 may be configured to determine whether maintenance of humidifier device 102 may be required based at least in part on peak value trend line 304 and/or low value trend line 306. For example, if the peak value trend delta at a particular time is larger than a specified threshold and/or if the low value trend delta at a particular time is larger than a specified threshold, control circuitry 110 may determine that maintenance of humidifier device 102 may be required. For example, in response to determining that maintenance of humidifier device 102 may be required to clean one or more sensors 114, control circuitry 110 may, for example, cause user interface device 116 to output an indication that maintenance of humidifier device 102 may be required. For example, user interface device 116 may output an audible alert (e.g., an audible alarm) or may output a visual indication (e.g., a warning message) that maintenance of humidifier device 102 should be performed.

In some examples, control circuitry 110 may shut down humidifier 102 if maintenance of humidifier device 102 is not performed after control circuitry 110 has determined that the peak value trend delta at a particular time is larger than the specified threshold and/or that the low value trend delta at a particular time is larger than the specified threshold. For example, after control circuitry 110 has determined that the peak value trend delta at a particular time is larger than the specified threshold and/or that the low value trend delta at a particular time is larger than the specified threshold, if control circuitry then determines that the peak value trend delta at a particular time is larger than a second specified threshold and/or that the low value trend delta at a particular time is larger than the second specified threshold, where the second specified threshold is greater than the specified threshold, control circuitry 110 may, in response, shut down humidifier device 102.

In some examples, control circuitry 110 may be configured to consider additional factors when compensating for inaccurate measurements produced by an example sensor. For example, when the example sensor is an air velocity sensor that produces instant values of air velocity measured by the air velocity sensor, changes in the fan speed of fan 106 in HVAC device 104 may produce large changes in the air velocity measured by the air velocity sensor. If control circuitry 110 compensates for the instant values 302 of the air velocity sensor at a current time based on the difference between the value of the peak value trend line 304 at the current time and the initial value of the peak trend line 304 at an initial time, an increase in the fan speed of fan 106 between the initial time and the current time may produce an inaccurate result.

In this example, when the fan speed of fan 106 changes, HVAC device 104 may send an indication of such a change in fan speed to control circuitry 110, such as via a communications bus or wire between HVAC device 104 and humidifier device 102. When control circuitry 110 determines that there is a step function increase in peak value trend line 304 versus a gradual increase, control circuitry 110 may determine that there has been a possible change in fan speed in HVAC device 104.

Figure 4:
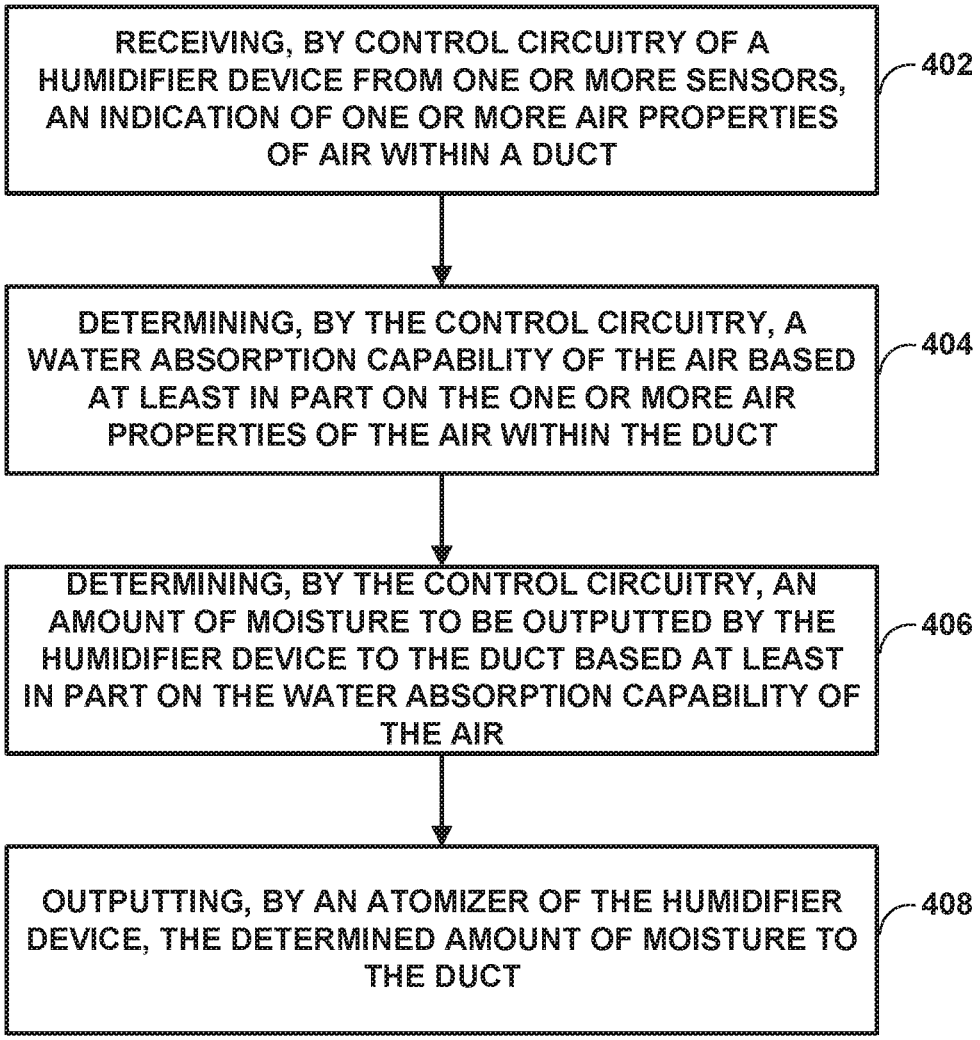
FIG. 4 illustrates an example process for individual driving of nebulizers based on HVAC conditions.

In response to determining that there has been a possible change in fan speed in HVAC device 104, control circuitry 110 may determine whether it has received an indication of such a change in fan speed from HVAC device 104 and, if so, may determine that a change in fan speed has occurred in HVAC device 104. If control circuitry 110 determines that a change in fan speed has occurred in HVAC device 104 that corresponds to a step function increase in peak value trend line 304, control circuitry 110 may exclude the step function increase in peak value trend line 304 from the difference between the value of the peak value trend line 304 at the current time and the initial value of the peak trend line 304 at an initial time. For example, control circuitry 110 may subtract the value of the step function increase in peak value trend line 304 from the difference between the value of the peak value trend line 304 at the current time and the initial value of the peak trend line 304 at an initial time (e.g., the peak value trend delta). In this way, control circuitry 110 may be able to consider additional factors when compensating for inaccurate measurements produced by an example sensor FIG. 4 illustrates an example process for individual driving of nebulizers based on HVAC conditions. Although described with respect to system 100 and humidifier device 102 of FIGS. 1 and 2, it should be understood that other devices may be configured to perform a method similar to that of FIG. 4.

As shown in FIG. 4, control circuitry 110 of humidifier device 102 may receive, from one or more sensors 114, an indication of one or more air properties of air within a duct 108 (402). The one or more air properties of the air includes one or more of: a relative humidity of the air, a temperature of the air, an air pressure of the air, or an air velocity of the air.

Control circuitry 110 may determine a water absorption capability of the air based at least in part on the one or more air properties of the air within the duct 108 (404). In some examples, control circuitry 110 may determine a theoretical water absorption capacity of the air based at least in part on one or more of: the relative humidity of the air, the temperature of the air, or the air pressure of the air, and may determine the water absorption capability of the air based at least in part on the theoretical water absorption capacity of the air, an area of a cross section of the duct 108, and the air velocity of the air.

Control circuitry 110 may determine an amount of moisture to be outputted by the humidifier device 102 to the duct 108 based at least in part on the water absorption capability of the air (406). In some examples, control circuitry 110 may determine a water flow of a single nebulizer element of the plurality of nebulizer elements 202 in the atomizer 12 and may determine the number of nebulizer elements of the plurality of nebulizer elements 202 in the atomizer 112 for outputting the determined amount of moisture to the duct 108 based at least in part on dividing the determined amount of moisture to be outputted to the duct by the water flow of the single nebulizer element.

Atomizer 112 of the humidifier device 102 may output the determined amount of moisture to the duct 108 (408). In some examples, control circuitry 110 may determine a number of nebulizer elements of a plurality of nebulizer elements 202 in the atomizer 112 for outputting the determined amount of moisture to the duct 108, where outputting the determined amount of moisture to the duct 108 may include control circuitry 110 individually driving the determined number of individual nebulizer elements of the plurality of nebulizer elements 202 to output the determined amount of moisture to the duct 108.

In some examples, a user interface device 116 operably coupled to the humidifier device 102 may receive user input indicative of an updated value for the area of the cross section of the duct 108. In response to receiving the user input indicative of the updated value for the area of the cross section of the duct 108, control circuitry 110 may: determine an updated water absorption capacity of the air based at least in part on the theoretical water absorption capacity of the air, the updated value for the area of the cross section of the duct 108, and the air velocity of the air, determine an updated amount of moisture to be outputted by the humidifier device 102 to the duct 108 based at least in part on the updated water absorption capability of the air, determine an updated number of nebulizer elements of the plurality of nebulizer elements 202 in the atomizer 112 for outputting the updated amount of moisture to the duct 108, and the atomizer 112 of the humidifier device 102 may output the updated amount of moisture to the duct 108, including control circuitry 110 individually driving the updated number of individual nebulizer elements of the plurality of nebulizer elements 202 to output the updated amount of moisture to the duct 108.

In some examples, control circuitry 110 may periodically receive, from the one or more sensors 114, an indication of a most recent one or more air properties of the air within the duct 108. Control circuitry 110 may periodically redetermine the water absorption capability of the air based at least in part on the most recent one or more air properties of the air within the duct 108. Control circuitry 110 may periodically redetermine the amount of moisture to be outputted by the humidifier device 102 to the duct 108 based at least in part on the redetermined water absorption capability of the air. Control circuitry 110 may determine an updated number of nebulizer elements of the plurality of nebulizer elements 202 in the atomizer 112 for outputting the redetermined amount of moisture to the duct 108. The atomizer 112 of the humidifier device 102 may output the redetermined amount of moisture to the duct 108, including control circuitry 110 individually driving the updated number of individual nebulizer elements of the plurality of nebulizer elements 202 to output the updated amount of moisture to the duct 108, the updated number of individual nebulizer elements being different from the number of individual nebulizer elements.

In some examples, an air flow sensor of one or more sensors 114 may measure air flow of the air in the duct 108 to determine instant values associated with the air flow measured by the air flow sensor over time. Control circuitry 110 may determine at least one of: a peak value trend based at least in part on peak values of the instant values or a low value trend based at least in part on low values of the instant values. Control circuitry 110 may determine that the air flow sensor is producing potentially inaccurate measurements of the air flow of the air based at least in part on at least one of: the peak value trend or the low value trend. Control circuitry 110 may compensate for the potentially inaccurate measurements of the air flow sensor based at least in part on at least one of: the peak value trend or the low value trend.

In some examples, to compensate for the potentially inaccurate measurements of the air flow sensor, control circuitry 110 may determine an initial peak value from the peak value trend and a peak value trend delta as a difference between a current value of the peak value trend and the initial peak value. Control circuitry 110 may add the peak value trend delta to a current value of the instant values.

In some examples, control circuitry 110 may, in response to determining that the peak value trend delta exceeds a first threshold, determine that maintenance is required for the air flow sensor. In response to determining that maintenance is required for the air flow sensor, humidifier device 102 may output an alert indicating that maintenance is required for the air flow sensor.

In some examples, control circuitry 110 may, in response to determining that the peak value trend delta exceeds a first threshold, redetermine the peak value trend delta. Control circuitry 110 may, in response to determining that the redetermined peak value trend delta exceeds a second threshold, the second threshold being greater than the first threshold, shut off the humidifier device 102.

In some examples, control circuitry 110 may determine a change in fan speed of a heating, ventilation, and air conditioning (HVAC) device 104 that outputs the air into the duct 108. Control circuitry 110 may determine a change in air flow caused by the change in fan speed. Control circuitry 110 may adjust the peak value trend delta based at least in part on the change in air flow caused by the change in fan speed.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable gate arrays (FPGAs), or other equivalent integrated or discrete logic circuitry. Accordingly, the terms "processor" and "processing circuitry." as used herein may refer to any of the foregoing structures or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses. Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various examples of the disclosure have been described. These and other examples are within the scope of the following claims.

The invention claimed is:

1. A method comprising:

receiving, by a control circuitry of a humidifier from one or more sensors, an indication of one or more air properties of air within a duct, wherein the one or more air properties of air within the duct include one or more of an air temperature, a relative humidity, or an air pressure;

determining, by the control circuitry, an amount of moisture to be outputted by the humidifier to the duct using the one or more air properties of air within the duct;

outputting, by an atomizer of the humidifier, the determined amount of moisture to the duct;

determining, by the control circuitry, a water flow of a single nebulizer element of a plurality of nebulizer elements in the atomizer; and determining, by the control circuitry, a number of nebulizer elements of the plurality of nebulizer elements in the atomizer for outputting the determined amount of moisture to the duct based at least in part on dividing the determined amount of moisture to be outputted to the duct by the water flow of the single nebulizer element;

wherein outputting the determined amount of moisture to the duct comprises individually driving, by the control circuitry, the determined number of individual nebulizer elements of the plurality of nebulizer elements to output the determined amount of moisture to the duct.

2. The method of claim 1, wherein the one or more air properties of the air includes one or more of: a relative humidity of the air, a temperature of the air, an air pressure of the air, or an air velocity of the air.

3. The method of claim 1, wherein:

receiving, by the control circuitry from the one or more sensors, the indication of the one or more air properties of the air within the duct comprises periodically receiving, by the control circuitry from the one or more sensors, an indication of a most recent one or more air properties of the air within the duct;

determining, by the control circuitry, the amount of moisture to be outputted by the humidifier to the duct based at least in part on the one or more air properties of the air within the duct comprises periodically redetermining, by the control circuitry, the amount of moisture to be outputted by the humidifier to the duct using the one or more air properties of the air within the duct;

determining, by the control circuitry, an updated number of nebulizer elements of the plurality of nebulizer elements in the atomizer for outputting the redetermined amount of moisture to the duct; and outputting, by the atomizer of the humidifier, the redetermined amount of moisture to the duct, including individually driving, by the control circuitry, the updated number of nebulizer elements of the plurality of nebulizer elements to output the updated amount of moisture to the duct, the updated number of individual nebulizer elements being different from the number of nebulizer elements.

4. The method of claim 1, further comprising:

measuring, by an air flow sensor, air flow of the air in the duct to determine instant values associated with the air flow measured by the air flow sensor over time;

determining, by the control circuitry, at least one of:

(i) a peak value trend based at least in part on peak values of the instant values or (ii) a low value trend based at least in part on low values of the instant values;

determining, by the control circuitry, that the air flow sensor is producing inaccurate measurements of the air flow of the air based at least in part on at least one of the peak value trend or the low value trend; and compensating, by the control circuitry, for the inaccurate measurements of the air flow based at least in part on at least one of the peak value trend or the low value trend.

5. The method of claim 4, wherein compensating for the inaccurate measurements of the air flow sensor comprises:

determining an initial peak value from the peak value trend;

determining a peak value trend delta as a difference between a current value of the peak value trend and the initial peak value; and adding the peak value trend delta to a current value of the instant values.

6. The method of claim 5, further comprising:

in response to determining that the peak value trend delta exceeds a first threshold, determining, by the control circuitry, that maintenance is required for the air flow sensor; and in response to determining that maintenance is required for the air flow sensor, outputting, by the humidifier, an alert indicating that maintenance is required for the air flow sensor.

7. The method of claim 6, further comprising:

in response to determining that the peak value trend delta exceeds a first threshold, redetermining, by the control circuitry, the peak value trend delta;

in response to determining that the redetermined peak value trend delta exceeds a second threshold, the second threshold being greater than the first threshold, shutting off, by the control circuitry, the humidifier.

8. The method of claim 6, further comprising:

determining, by the control circuitry, a change in fan speed of a heating, ventilation, and air conditioning (HVAC) device that outputs the air into the duct;

determining, by the control circuitry, a change in air flow caused by the change in fan speed; and adjusting, by the control circuitry, the peak value trend delta based at least in part on the change in air flow caused by the change in fan speed.

9. A humidifier comprising:

one or more sensors configured to sense one or more air properties of air within a duct operably coupled to the humidifier;

a control circuitry configured to:

receive, from the one or more sensors, an indication of the one or more air properties of the air within the duct, wherein the one or more air properties of air within the duct include one or more of an air temperature, a relative humidity, or an air pressure; and determine an amount of moisture to be outputted by the humidifier to the duct using the one or more air properties of the air within the duct; and an atomizer configured to output the determined amount of moisture to the duct, wherein the atomizer includes a plurality of nebulizer elements;

wherein the control circuitry is further configured to:

determine a water flow of a single nebulizer element of the plurality of nebulizer elements in the atomizer;

determine a number of nebulizer elements of the plurality of nebulizer elements in the atomizer for outputting the determined amount of moisture to the duct based at least in part on dividing the determined amount of moisture to be outputted to the duct by the water flow of the single nebulizer element; and drive the determined number of nebulizer elements of the plurality of nebulizer elements to output the determined amount of moisture to the duct.

10. The humidifier of claim 9, wherein the one or more air properties of the air includes one or more of: a relative humidity of the air, a temperature of the air, an air pressure of the air, or an air velocity of the air.

11. The humidifier of claim 9, wherein:

the control circuitry that is configured to receive, from the one or more sensors, the indication of the one or more air properties of the air within the duct is further configured to periodically receive, from the one or more sensors, an indication of a most recent one or more air properties of the air within the duct;

the control circuitry that is configured to determine the amount of moisture to be outputted by the humidifier to the duct using the one or more air properties of the air within the duct is further configured to periodically redetermine the amount of moisture to be outputted by the humidifier to the duct using the one or more air properties of the air within the duct;

the control circuitry is further configured to determine an updated number of nebulizer elements of the plurality of nebulizer elements in the atomizer for outputting the redetermined amount of moisture to the duct; and the control circuitry is further configured to drive the updated number of nebulizer elements of the plurality of nebulizer elements to output the updated amount of moisture to the duct, the updated number of nebulizer elements being different from the number of nebulizer elements.

12. The humidifier of claim 9, wherein:

an air flow sensor of the one or more sensors is configured to measure air flow of the air in the duct to determine instant values associated with the air flow measured by the air flow sensor over time; and the control circuitry is further configured to:

determine at least one of: a peak value trend based at least in part on peak values of the instant values or a low value trend based at least in part on low values of the instant values;

determine that the air flow sensor is producing inaccurate measurements of the air flow of the air based at least in part on at least one of: the peak value trend or the low value trend; and compensate for the inaccurate measurements of the air flow based at least in part on at least one of: the peak value trend or the low value trend.

13. A method comprising:

receiving, by a control circuitry of a humidifier from one or more sensors, an indication of one or more air properties of air within a duct, wherein the one or more air properties of air within the duct include one or more of an air temperature, a relative humidity, or an air pressure;

determining, by the control circuitry, an amount of moisture to be outputted by the humidifier to the duct using the one or more air properties of air within the duct; and outputting, by an atomizer of the humidifier, the determined amount of moisture to the duct;

measuring, by an air flow sensor, air flow of the air in the duct to determine instant values associated with the air flow measured by the air flow sensor over time;

determining, by the control circuitry, at least one of:

(i) a peak value trend based at least in part on peak values of the instant values or (ii) a low value trend based at least in part on low values of the instant values;

determining, by the control circuitry, that the air flow sensor is producing inaccurate measurements of the air flow of the air based at least in part on at least one of: one of the peak value trend or the low value trend; and compensating, by the control circuitry, for the inaccurate measurements of the air flow based at least in part on at least one of the peak value trend or the low value trend.

* * * * *